US008449646B1

(12) United States Patent
Lim et al.

(10) Patent No.: US 8,449,646 B1
(45) Date of Patent: May 28, 2013

(54) METHOD FOR PREPARING TITANIUM POWDER WITH LOW OXYGEN CONCENTRATION

(75) Inventors: Jae-Won Lim, Daejeon (KR); Jung-Min Oh, Daejeon (KR); Back-Kyu Lee, Daejeon (KR); Chang-Youl Suh, Daejeon (KR); Sung-Wook Cho, Daejeon (KR)

(73) Assignee: Korea Institute of Geoscience and Mineral Resources (KR)

( * ) Notice: Subject to any disclaimer, the term of this patent is extended or adjusted under 35 U.S.C. 154(b) by 0 days.

(21) Appl. No.: 13/551,399

(22) Filed: Jul. 17, 2012

(30) Foreign Application Priority Data

Nov. 18, 2011 (KR) ..... 10-2011-0120834

(51) Int. Cl.
*B22F 9/22* (2006.01)

(52) U.S. Cl.
USPC ..... 75/364; 75/367; 75/369

(58) Field of Classification Search
None
See application file for complete search history.

(56) References Cited

U.S. PATENT DOCUMENTS

| | | | | |
|---|---|---|---|---|
| 4,445,931 | A * | 5/1984 | Worthington | 75/343 |
| 5,171,359 | A * | 12/1992 | Megy | 75/230 |
| 6,171,363 | B1 * | 1/2001 | Shekhter et al. | 75/369 |
| 2009/0214378 | A1 | 8/2009 | Haas et al. | |
| 2010/0064852 | A1 * | 3/2010 | Zhang | 75/366 |
| 2010/0243468 | A1 * | 9/2010 | Mu et al. | 205/349 |

FOREIGN PATENT DOCUMENTS

| | | |
|---|---|---|
| JP | 2004-68150 | 3/2004 |
| KR | 1999-0048242 | 7/1999 |
| KR | 10-2007-0051957 | 5/2007 |

* cited by examiner

*Primary Examiner* — George Wyszomierski
(74) *Attorney, Agent, or Firm* — Christie, Parker & Hale, LLP

(57) ABSTRACT

Disclosed is a method for preparing low-oxygen titanium powders. The method includes (a) separately placing titanium base powders and calcium in a deoxidation container, (b) deoxidizing the titanium base powders by heating an inner part of the deoxidation container at a temperature of 850° C. to 1050° C. so that the calcium is evaporated to make contact with the titanium base powders, (c) removing calcium oxide from surfaces of titanium powders, which are obtained by deoxidizing the titanium base powders in step (b), by washing the titanium powders, and (d) drying the titanium powders subject to the removing of the calcium oxide in step (c).

3 Claims, 3 Drawing Sheets

METHOD FOR PREPARING TITANIUM POWDER WITH LOW OXYGEN CONCENTRATION

CROSS-REFERENCE TO RELATED APPLICATION

This application claims the benefit under 35 U.S.C. §119 of Korean Patent Application No. 10-2011-0120834 filed on Nov. 18, 2011 in the Korean Intellectual Property Office, the entirety of which disclosure is incorporated herein by reference.

BACKGROUND OF THE INVENTION

1. Field of the Invention

The present invention relates generally to a method for preparing titanium powders. In more particular, the present invention relates to a deoxidation apparatus for preparing a low-oxygen titanium powder having an oxygen concentration of 1,000 ppm or less from common titanium powders having an oxygen concentration of about 2,200 ppm.

2. Description of the Related Art

Titanium (Ti) is a material representing very superior durability and corrosion resistance with a light weight. Accordingly, titanium (Ti) has been utilized in various fields such as an aerospace field, an ocean equipment field, a chemical industry field, a nuclear power generation field, a biomedical field, and an automobile field.

Common titanium (Ti) has an oxygen concentration of about 2,000 ppm to about 10,000 ppm. Accordingly, many researches and studies have been performed to prepare high-purity titanium.

The researches and studies on the preparation of the high-purity titanium are mainly focused on the control of gas impurities, that is, the development of a deoxidation process.

In order to reduce oxygen from titanium through the deoxidation process, there is suggested a scheme of dissolving calcium (Ca) by using halide flux such as calcium chloride ($CaCl_2$), and dissolving calcium oxide (CaO) come from the deoxidation process in the flux. However, according to the scheme based on the halide flux, a complex mechanical process such as a pulverizing process must be performed after the deoxidation process has been performed. If the source material has the form of powders, superior powders may not be obtained through the process.

The related art of the present invention discloses high-purity titanium and a method for preparing the same in Korean Unexamined Patent Application No. 10-1987-0011265 (published on Dec. 22, 1987).

SUMMARY OF THE INVENTION

Accordingly, the present invention has been made keeping in mind the above problems occurring in the prior art, and an object of the present invention is to a method for preparing low-oxygen titanium powders, capable of reducing oxygen contained in common titanium powders as much as possible through a simpler scheme.

To accomplish the above object, according to one aspect of the present invention, there is provided a method for preparing low-oxygen titanium powders. The method includes (a) separately placing titanium base powders and calcium in a deoxidation container, (b) deoxidizing the titanium base powders by heating an inner part of the deoxidation container at a temperature of 850° C. to 1050° C. so that the calcium is evaporated to make contact with the titanium base powders, (c) removing calcium oxide from surfaces of titanium powders, which are obtained by deoxidizing the titanium base powders in step (b), by washing the titanium powders, and (d) drying the titanium powders subject to the removing of the calcium oxide in step (c).

In this case, preferably, in step (a), 100 weight part of the titanium base powders and 50 weight part to 200 weight part of the calcium are placed.

In addition, step (c) may be performed through at least one of a water washing process and an acid washing process.

Further, step (d) may be performed through vacuum drying.

As described above, according to the method of preparing low-oxygen titanium powders of the present invention, oxygen can be removed from titanium base powders by using calcium as a deoxidizer, and the deoxidation process can be performed at a temperature of a melting point of calcium or more.

Accordingly, the titanium powders prepared according to the method of the present invention represents lower oxygen concentrations as compared with the oxygen concentration of titanium powders prepared by performing a deoxidation process at a temperature of the melting point of calcium or less. Accordingly, low-oxygen titanium powders can be prepared.

DETAILED DESCRIPTION OF THE INVENTION

Figure 1:
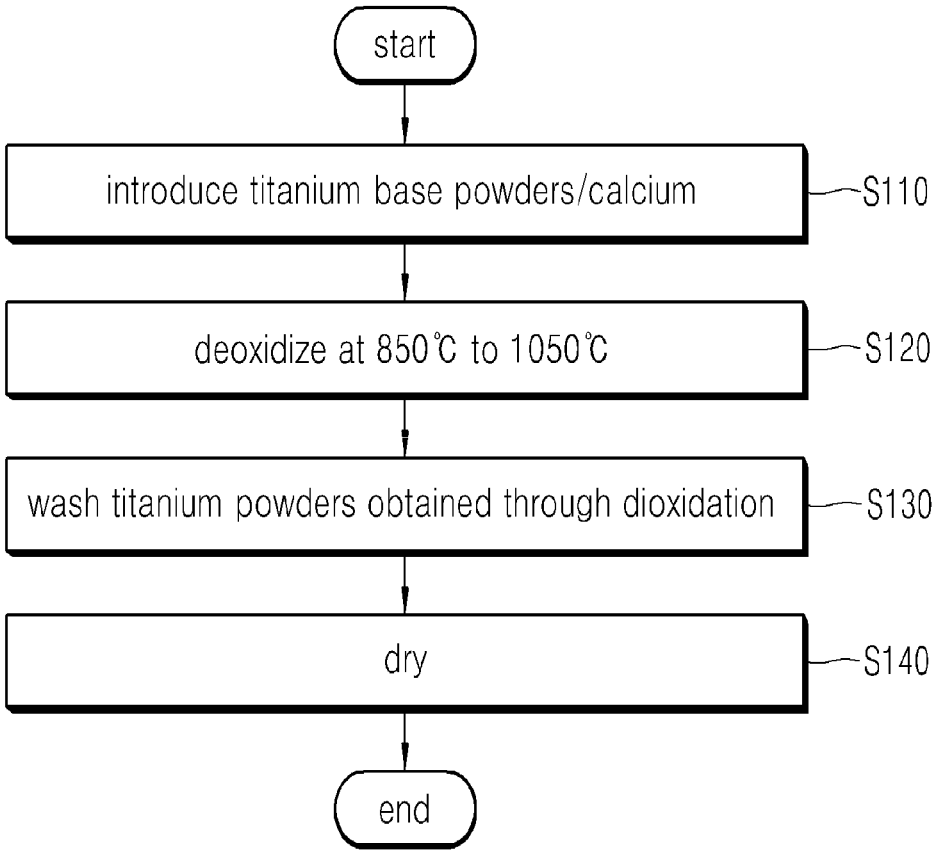
FIG. 1 is a flowchart schematically showing a method for preparing low-oxygen titanium powders according to one embodiment of the present invention.

Advantages and/or characteristics of the present invention, and methods to accomplish them will be apparently comprehended by those skilled in the art when making reference to embodiments in the following description and accompanying drawings. However, the present invention is not limited to the following embodiments, but various modifications may be realized. The present embodiments are provided to make the disclosure of the present invention perfect and to make those skilled in the art perfectly comprehend the scope of the present invention. The present invention is defined only within the scope of claims. The same reference numerals will be used to refer to the same elements throughout the specification.

Hereinafter, a method for preparing low-oxygen titanium powders according to an exemplary embodiment of the present invention will be described in detail with reference to accompanying drawings.

FIG. 1 is a flowchart schematically showing a method for preparing low-oxygen titanium powders according to one embodiment of the present invention.

Referring to FIG. 1, the method for preparing low-oxygen titanium powders includes a step of placing titanium base powders/calcium (step S110), a deoxidation step (step S120), a washing step (step S130), and a drying step (step S140).

In the step of placing titanium base powders/calcium (step S110), titanium base powders and calcium are separately placed in a deoxidation container.

The titanium base powders include common titanium powders having the oxygen concentration of about 2,200 ppm.

According to the present invention, titanium base powders and calcium are separately placed in the deoxidation container. If the titanium base powders and calcium are placed together in the deoxidation container, when taking into consideration that the deoxidation step (step S120), which will be described later, is performed at the temperature of at least the melting point of calcium, calcium may not be separated from titanium powders due to the melting of the calcium after the deoxidation step (step S120) has been performed.

In this case, 100 weight part of titanium base powders and 50 weight part to 200 weight part of calcium are more preferably placed. If less than 50 weight part of calcium is used with respect to 100 weight part of titanium base powders, an amount of evaporated calcium is insufficient so that deoxidation effect may be degraded. In contrast, if more than 200 weight part of calcium is used with respect to 100 weight part of titanium base powders, only an amount of used calcium may be increased without the improvement of the deoxidation effect.

Next, in the deoxidation step (step S120), calcium is evaporated while making contact with the titanium base powders by heating the inner part of the deoxidation container at the temperature of the melting point of calcium or more for about one hour to about three hours. When evaporated calcium makes contact with the titanium base powders, the following deoxidation reaction occurs, so that oxygen is removed from the titanium base powders.

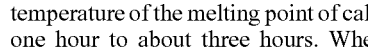

$$Ca(g)+O(\text{in Ti powder})\text{->}CaO(s).$$

Naturally, the deoxidation reaction occurs at the temperature of less than of the melting point of calcium. However, when the deoxidation process is performed at the temperature of less than the melting point of calcium and more than the melting point of calcium under the same condition, the deoxidation process performed at the temperature of more than the melting point of calcium represents deoxidation effect greater than that of the deoxidation process performed at the temperature of less than the melting point of calcium. Accordingly, in the present invention, the deoxidation process is performed at the temperature of more than the melting point of calcium.

In this case, the deoxidation temperature is preferably in the range of 850° C. to 1050° C. If the deoxidation temperature is less than 850° C., an amount of evaporated calcium is insufficient, so that the deoxidation reaction may insufficiently occur. In contrast, if the deoxidation temperature exceeds 1050° C., calcium oxide (CaO) may not be completely removed from the surface of the titanium powders due to the sintering and the cohesion phenomenon. Accordingly, low-oxygen titanium powders may not be acquired.

Thereafter, in the washing step (step S130), a calcium oxide (CaO) is removed from the surface of titanium powders subject to the deoxidation process by washing the titanium powders.

The washing step (step S130) may be performed through at least one of a water washing process and an acid washing process. In the case of the acid washing process, about 10 weight % of an HCI solution can be used. In order to obtain low-oxygen titanium powder, the water washing process and the acid washing process are preferably repeated several times.

Thereafter, in the drying step (step S140), final titanium powders are obtained by drying the titanium powders without the calcium oxide (CaO).

Although the drying step (step S140) can be performed through various schemes, vacuum drying is more preferable in order to obtain the low-oxygen titanium powders.

The vacuum drying may be performed at the temperature of about 60° C. for 2 hours.

Embodiment

Hereinafter, the method for preparing the low-oxygen titanium powders according to the exemplary embodiment of the present invention will be described. The following exemplary embodiments are illustrative purpose only and the present invention is not limited thereto.

Description about known functions and structures, which can be anticipated by those skilled in the art, will be omitted.

1. Experimental Equipment

Figure 2:
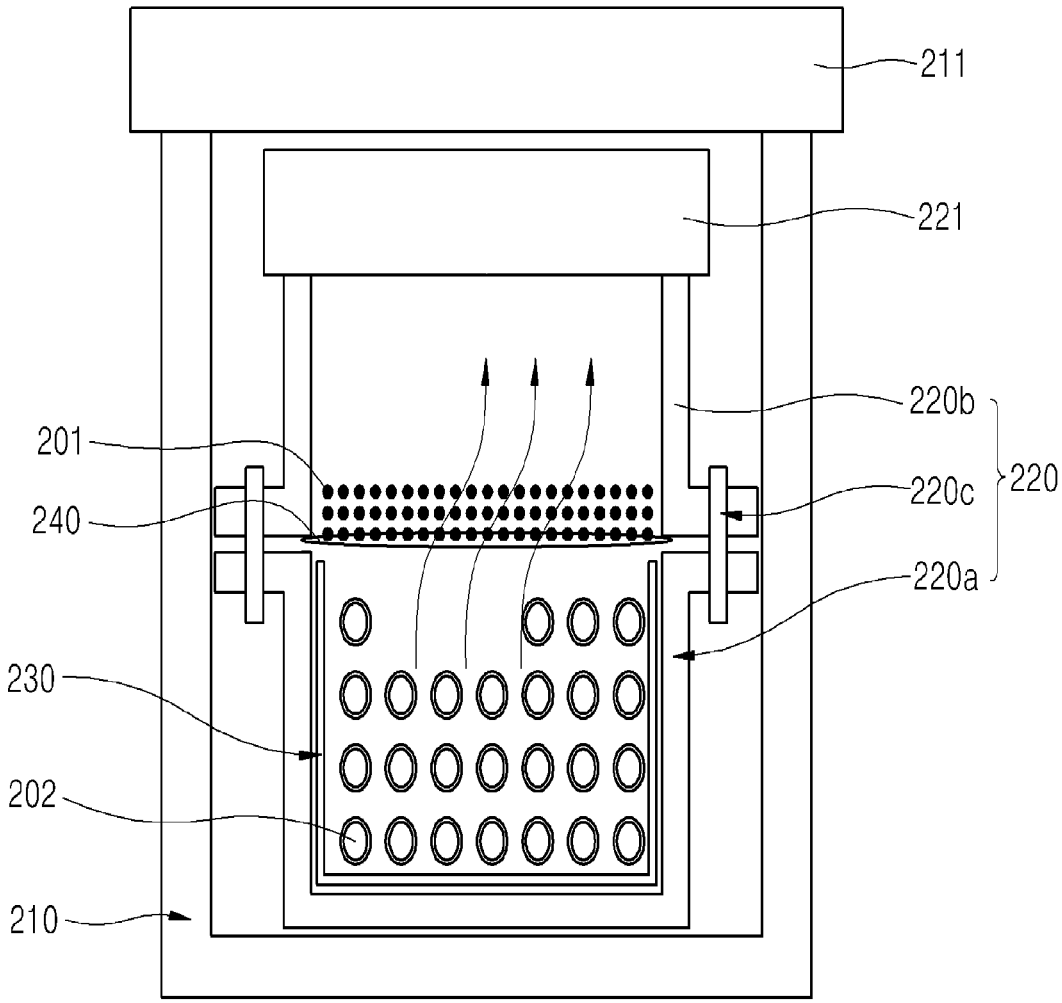
FIG. 2 is a view showing an apparatus for preparing low-oxygen titanium powders according to the present invention.

In order to perform the present experiment, a deoxidation apparatus that was specially manufactured was used as shown in FIG. 2.

An external container 210 was used to prevent evaporated calcium from leaking. The external container 210 was made of steel.

An internal container 220 included a lower container 220*a*, an upper container 220*b*, and a coupling part 220*c* coupling the lower container 220*a* with the upper container 220*b*. The parts of the internal container 220 were made of steel.

The upper container 220*a* had titanium powders 201 introduced therein, and was coupled with a sieve 240 at the lower portion thereof. In addition, the edge of the sieve 240 was secured by a gasket to prevent the sieve from being moved. Further, a 150-mesh sieve 240 was used to prevent the titanium powders 202 from being dropped.

The lower container 220*b* was designed in such a manner that the calcium 202 was evaporated upward at the high temperature. In addition, if calcium was directly introduced into the lower container 220*b*, the calcium were not completely removed after the deoxidation process had been performed. Therefore, in order to reuse the lower container 220*b*, a disposable calcium container 230 was used to store calcium.

After the internal container 220 had been disposed, the deoxidation container was sealed by using an internal container cover 221 and an external container cover 211.

2. Preparation of Titanium Powders

First Embodiment

A deoxidation process was performed by employing common titanium powders (99.9%, high-purity chemical, Japan) having an oxygen concentration of 2,200 ppm as titanium base powders and using metallic calcium. An average particle size of the titanium base powders was analyzed as 150 μm. Titanium powders were introduced into the deoxidation container shown in FIG. 2 together with calcium having the content of 100 weight % based on the weight of titanium. The deoxidation process was performed at the temperature of about 900° C. for 2 hours.

Thereafter, titanium powders were acquired by performing a vacuum drying process at the temperature of about 60° C. for 2 hours after performing the water washing process and the acid washing process (10 weight % HCl solution) with respect to the deoxidized titanium powders three times.

Second Embodiment

Titanium powders was acquired under the same condition as that of the first embodiment except that the deoxidation process was performed at the temperature of 1000° C.

First Comparative Example

The deoxidation process was performed at the temperature of 800° C. Titanium powders was acquired under the condition in which titanium base powders were placed together with calcium for the deoxidation process.

Second Comparative Example

Titanium powders was acquired under the same condition as that of the first embodiment except that the deoxidation process was performed at the temperature of 1,100° C.

3. Measurement of Oxygen Concentration

Figure 3:
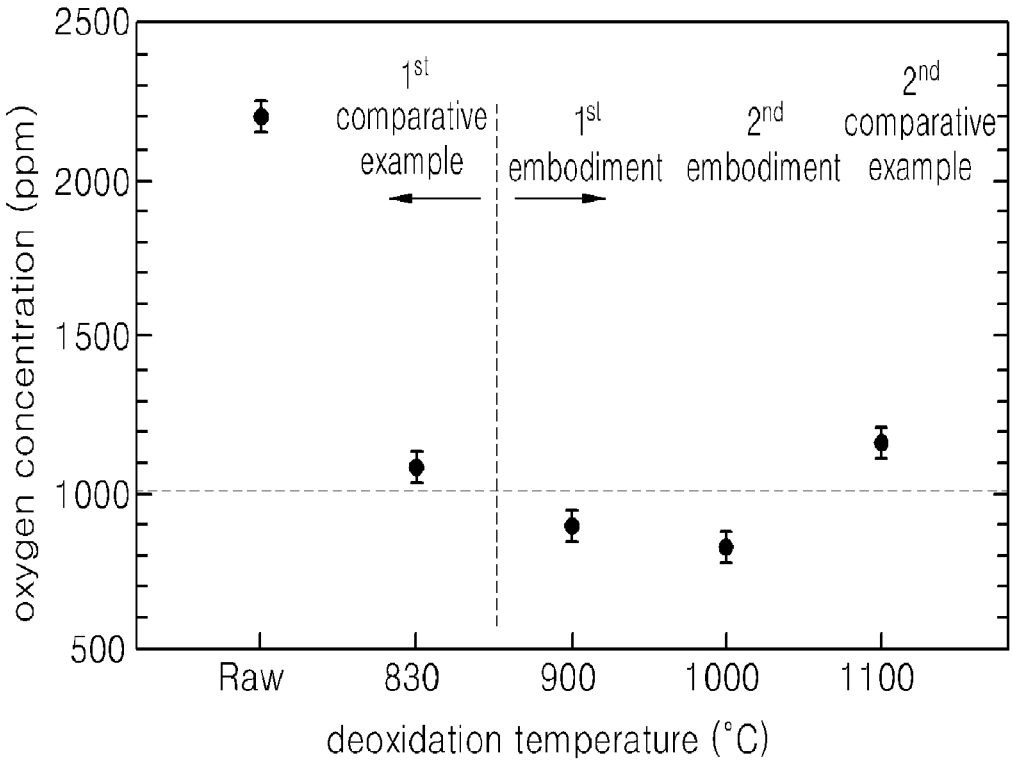
FIG. 3 is graph showing the oxygen concentration of titanium powders prepared according to the first and second embodiments and the first and second comparative examples.

Thereafter, oxygen concentration of the titanium powders prepared according to the first and second embodiments and the first and second comparative examples was measured by using an oxygen/nitrogen analyzer (LECO TC-436), and the measurement results are shown in FIG. 3.

Referring to FIG. 3, titanium powders, which were prepared according to the first and second embodiments employing a deoxidation temperature equal to or greater than the temperature of the melting point (848° C.) of calcium, represented oxygen concentration of 1,000 ppm or less.

In contrast, titanium powers, which were prepared according to the first comparative example employing a deoxidation temperature less than the temperature of the melting point of calcium, and titanium powders, which were prepared according to the second comparative example employing a deoxidation temperature exceeding the temperature of 1,050° C., represented the oxygen concentration of 1,000 ppm.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A method for preparing low-oxygen titanium powders, the method comprising the steps of:

(a) placing 100 weight part of titanium base powders in an upper container of a deoxidation container and separately placing 50 to 200 weight part of calcium in a lower container of the deoxidation container the deoxidation chamber including a coupling part which couples the upper container and the lower container, and a sieve between the upper container and the lower container which separates the upper container from the lower container;

(b) deoxidizing the titanium base powders by heating an inner part of the deoxidation container at a temperature of 850° C. to 1050° C. so that the calcium is evaporated upwards through the sieve to make contact with the titanium base powders;

(c) removing calcium oxide from surfaces of titanium powders, which are obtained by deoxidizing the titanium base powders in step (b), by washing the titanium powders; and (d) drying the titanium powders subject to the removing of the calcium oxide in step (c).

2. The method of claim 1, wherein step (c) is performed through at least one of a water washing process and an acid washing process.

3. The method of claim 1, wherein step (d) is performed through vacuum drying.

* * * * *